US008668096B2

(12) United States Patent
Von De Linde

(10) Patent No.: US 8,668,096 B2
(45) Date of Patent: Mar. 11, 2014

(54) SHELF

(75) Inventor: Keith Von De Linde, Brooklyn Park, MN (US)

(73) Assignee: Anchor Mfg., Inc., Eagan, MN (US)

( * ) Notice: Subject to any disclaimer, the term of this patent is extended or adjusted under 35 U.S.C. 154(b) by 229 days.

(21) Appl. No.: 13/227,192

(22) Filed: Sep. 7, 2011

(65) Prior Publication Data

US 2013/0056433 A1 Mar. 7, 2013

(51) Int. Cl.
*A47F 5/08* (2006.01)

(52) U.S. Cl.
USPC ..... 211/90.02; 248/235

(58) Field of Classification Search
USPC ..... 108/137, 143; 211/134, 153, 175, 189, 211/90.02, 87.01, 193; 312/334.1, 334.7, 312/350; 248/235, 244, 298.1, 27.1
See application file for complete search history.

(56) References Cited

U.S. PATENT DOCUMENTS

| | | | | | |
|---|---|---|---|---|---|
| 2,292,797 | A | * | 8/1942 | Roberts | 108/45 |
| 3,567,261 | A | * | 3/1971 | Akczinski | 403/106 |
| 3,913,746 | A | * | 10/1975 | Burton | 211/64 |
| 4,079,604 | A | * | 3/1978 | Anderegg | 70/58 |
| 4,482,066 | A | * | 11/1984 | Dykstra | 211/151 |
| 4,736,689 | A | * | 4/1988 | Stanko | 108/5 |
| 4,971,315 | A | | 11/1990 | Rector | |
| 5,487,525 | A | * | 1/1996 | Drabczyk et al. | 248/639 |
| 5,490,471 | A | | 2/1996 | Haggerty | |
| 5,598,788 | A | * | 2/1997 | Jonker | 108/147 |
| 5,628,274 | A | | 5/1997 | Biedenweg et al. | |
| 5,720,230 | A | * | 2/1998 | Mansfield | 108/108 |
| 5,895,020 | A | * | 4/1999 | Danzyger et al. | 248/295.11 |
| 5,947,434 | A | * | 9/1999 | Kosmoski et al. | 248/298.1 |
| 6,101,966 | A | * | 8/2000 | Cumisky | 114/364 |
| 6,189,429 | B1 | * | 2/2001 | Liu | 83/477 |
| 6,223,908 | B1 | * | 5/2001 | Kurtsman | 211/26 |
| 6,431,668 | B1 | * | 8/2002 | Reddicliffe | 312/334.5 |
| 7,011,036 | B1 | | 3/2006 | Hill | |
| 7,028,632 | B2 | | 4/2006 | Blank | |
| 7,134,400 | B2 | | 11/2006 | Blank | |
| 7,311,211 | B2 | * | 12/2007 | Chung | 211/90.02 |
| 7,654,208 | B2 | * | 2/2010 | Patten | 108/96 |
| 7,780,254 | B2 | * | 8/2010 | Wang et al. | 312/334.7 |
| 2002/0092662 | A1 | * | 7/2002 | Grant et al. | 174/50 |
| 2003/0079661 | A1 | * | 5/2003 | Luu | 108/116 |
| 2004/0035983 | A1 | * | 2/2004 | Simonson et al. | 248/49 |
| 2005/0160962 | A1 | | 7/2005 | Wright | |
| 2006/0191449 | A1 | * | 8/2006 | Patten | 108/138 |
| 2009/0050589 | A1 | * | 2/2009 | Pedler et al. | 211/85.8 |
| 2010/0175608 | A1 | | 7/2010 | Heckaman et al. | |

* cited by examiner

*Primary Examiner* — Darnell Jayne
*Assistant Examiner* — Hiwot Tefera
(74) *Attorney, Agent, or Firm* — Thomas J. Nikolai; Nikolai & Mersereau, P.A.

(57) ABSTRACT

A shelf including a mounting bracket having two arms is provided. The length of the arms and the distance between the arms are adjustable so the shelf may be attached to and project outwardly from various support structures.

1 Claim, 4 Drawing Sheets

SHELF

CROSS-REFERENCED TO RELATED APPLICATIONS

Not applicable.

STATEMENT REGARDING FEDERALLY SPONSORED RESEARCH OR DEVELOPMENT

Not applicable.

BACKGROUND OF THE INVENTION

I. Field of the Invention

The present invention relates generally to shelving. More particularly, the present invention relates to shelving mountable to a support at the rear of the shelf such that the shelf projects from the support.

II. Related Art

Boat decks, for example, pontoon boat decks, often become cluttered with gear during a recreational boating excursion. Gear such as life preservers, towels, fishing equipment, food and beverages can become unpleasant to use if they become cold or wet. Substantial quantities of water can enter a boat when one lifts the boat's anchor and places on the boat's deck the anchor and the line used to tie the anchor to the boat. Problems with the anchor and the line adding to clutter on the boat deck or causing water to enter the boat can be alleviated if the anchor and line are placed on a shelf which extends outwardly from the boat.

For whatever reasons, such shelving has typically not been included in boat designs provided by pontoon boat manufacturers. Also, after-market shelving has typically not been available. The absence of such after-market shelving from the marketplace can be attributed to the different manner in which boats are constructed and the difficulty attaching standard shelves to such boats in a visually pleasing and secure manner. Unusual pontoon boat shelves generally are not available.

SUMMARY OF THE INVENTION

To overcome the deficiencies discussed above with respect to pontoon boat and shelving design, the present invention was made. Those skilled in the art will appreciate that application of the invention is not limited to pontoon boats or even to watercraft more generally. The present invention provides a shelf comprising a frame having a mounting plate, a top plate supported by the frame extending from the mounting plate in a first direction, and a bracket supporting the frame and extending from the mounting plate in a second direction. The bracket comprises first and second arms projecting substantially parallel to each other at a distance which is adjustable. The length of each arm is also independently adjustable. Fasteners are used to couple the arms to one or more supporting structures. When the shelf is used with a boat, these support structures are part of the boat itself. More specifically, the arms can be fastened to a single supporting structure located between the two arms. Alternatively, the arms can be attached to two supporting structures—one on either side of the bracket. When so attached to one or more supporting structures, the shelf is held in a generally horizontal position so that items, such as the anchor and line used to attach the anchor to a boat, can be placed on the top plate.

In addition to the mounting plate, the frame may include one or more additional plates which help support the top plate. To enable both the length of the arms and the distance between the arms of the bracket to be adjustable, the arms may include an L-shaped adjustment member having a first leg in face-to-face registration with the mounting plate of the frame and coupled thereto by a fastener. Typically this leg of the adjustment member or the frame (or both) will have an elongated slot through which the fastener is placed to couple the adjustment member to the mounting plate. The presence of this slot through which the fastener is placed permits the distance between the arms to be adjusted. To enable the length of the arms of the brackets to be adjustable, the adjustment member may include a second leg projecting in a direction substantially normal to the first leg and having a slot through which a fastener passes to connect a mounting member of the leg to the adjustment member of the leg.

A shelf made in conformance with the present invention may comprise a shelf attached to a support, the shelf comprising a frame having a front plate, a mounting plate spaced from the front plate and a pair of side plates; a top plate supported by the frame extending from the mounting plate toward the front plate; and a bracket supporting the frame, the bracket comprising first and second arms extending substantially parallel to each other from the mounting plate in a direction away from the front plate, each arm comprising an adjustment member and a mounting member, the adjustment member having a first leg including a first opening (which may be in the form of an elongate slot), the first leg in face-to-face registration with the mounting surface of the mounting plate, and a second leg including a second opening (which may be in the form of an elongate slot) extending from the first leg in a direction substantially normal (i.e., at approximately 90°) to the first leg, the second leg of the adjustment member coupled to the mounting member. Fasteners cooperate with the openings of the first legs of the adjustment members of the first and second arms to couple the first and second arms to the mounting plate a desired distance from each other. This distance is adjustable. Second fasteners cooperate with the openings of the second legs of the adjustment members to couple the mounting members of the arms to the adjustment members of the arms. The length of the arms is adjustable. Fasteners are also provided to couple each of the mounting members of the bracket to a support structure. The support structure may be a single support located between the two arms to which the mounting members of the two arms are fastened. Alternatively, the support structure may include two supports, one on either side of the bracket, each such that mounting members are fastened to a separate support located adjacent the mounting member. Such fasteners can pass through holes drilled through the mounting members of the bracket. If these fasteners are in the form of a screw, by way of example, pilot holes can be drilled into the support(s). To ensure proper placement of the pilot holes, a template matching the location of pre-drilled holes through the mounting members of the bracket may be provided.

DETAILED DESCRIPTION

Figure 1:
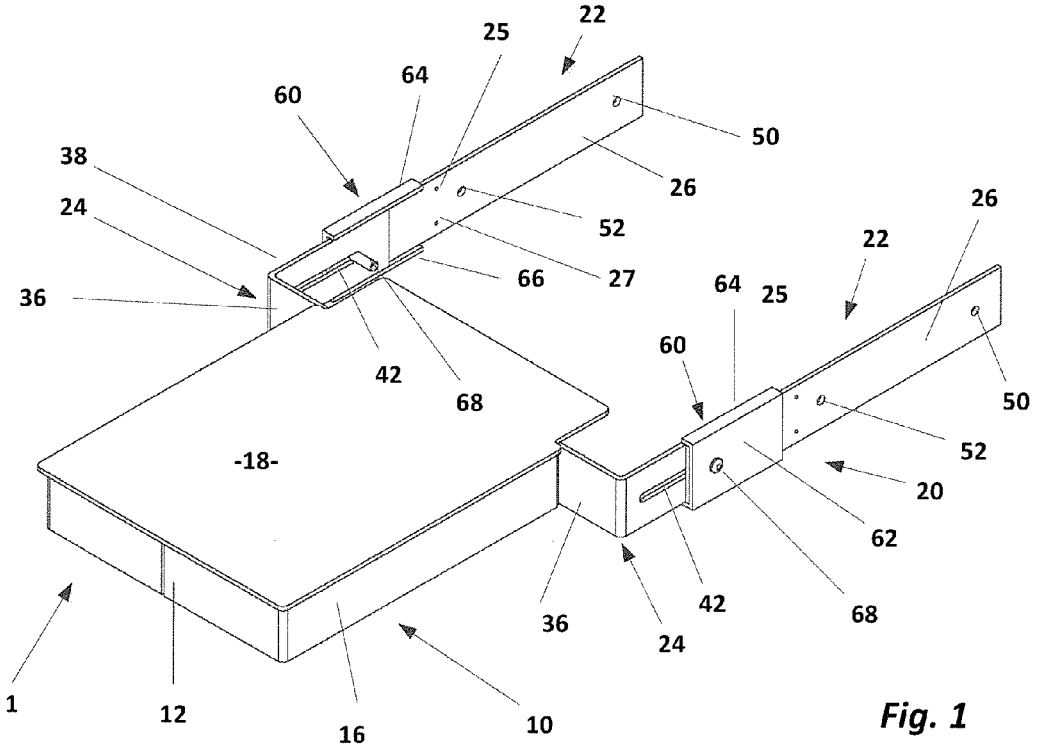
FIG. 1 is a perspective view showing a shelf made in accordance with the present invention.

The concepts of the present disclosure may be employed in various alternative forms. The following description of specific exemplary embodiments shown by way of the drawings is provided to meet the disclosure requirements of the patent laws. However, the reader should understand that the present invention is not limited to the embodiment shown in the drawing or described herein.

Turning to FIG. 1, a shelf 1 made in accordance with the present invention is shown. The shelf includes a frame 10 comprising a front plate 12, a mounting plate 14 (shown in FIG. 3) which is opposed to front plate 12 and a pair of spaced apart side plates 16, one of which is shown in FIG. 1. The side plates 16 extend between the front plate 12 and the mounting plate 14. The shelf also includes a top plate 18 and a bracket 20. The bracket 20 comprises a pair of arms 22. Each arm includes an adjustment member 24 and a mounting member 26.

Figure 3:
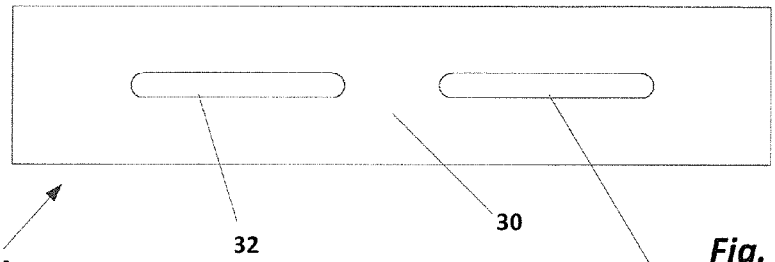
FIG. 3 is a plan view of the mounting plate of the frame of the shelf shown in FIG. 1.

As best shown in FIG. 3, the mounting plate 14 of the frame includes a substantially planar mounting surface 30. Defined within the mounting surface 30 and extending through the mounting plate 14 of frame 10 is a pair of elongate slots 32 and 34.

Figure 5:
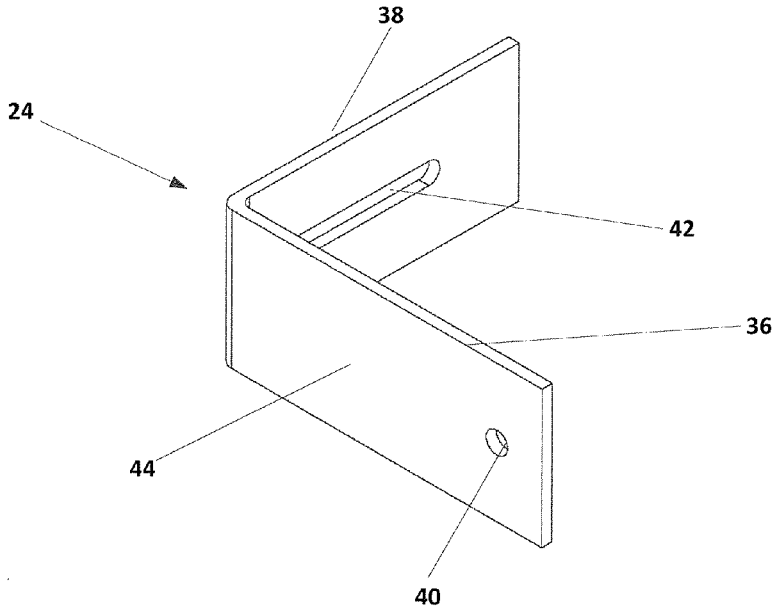
FIG. 5 is a perspective view of one of the adjustment members of the bracket of the shelf shown in FIG. 1.
Figure 6:
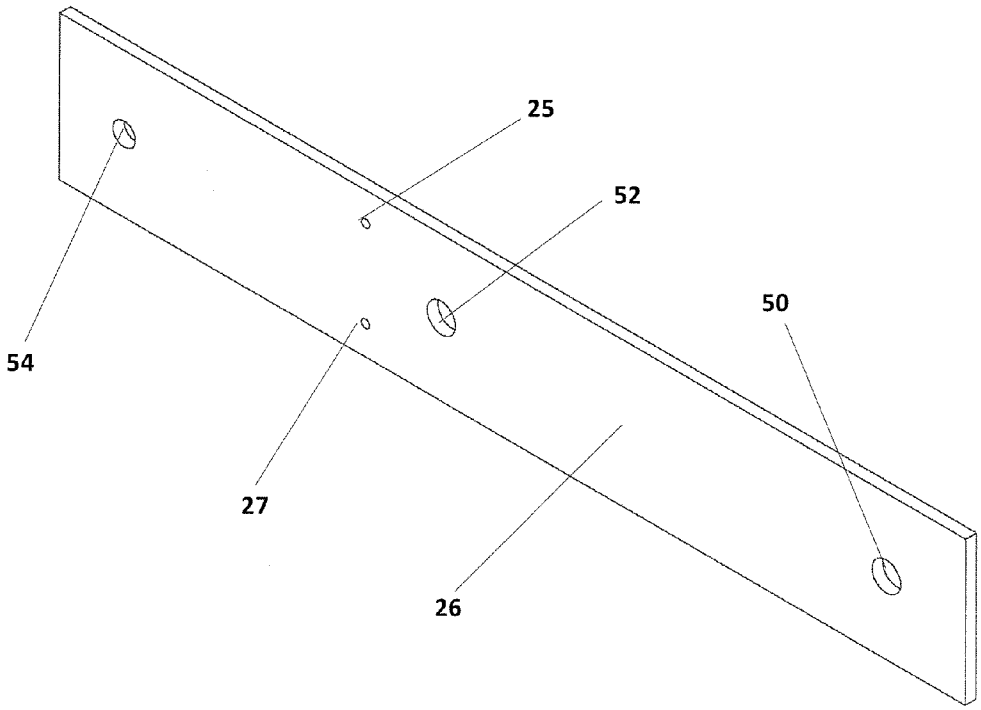
FIG. 6 is a perspective view of one of the mounting members of the bracket of the shelf shown in FIG. 1.

As best shown in FIG. 5, each adjustment member 24 includes a first leg 36 and a second leg 38 extending from one end of the first leg 36 in a direction substantially normal to (i.e., approximately 90° from) the first leg 36. The first leg 36 includes an opening 40. While this opening is shown as a circular opening in FIG. 5, those skilled in the art will recognize that this opening can also be an elongate slot without deviating from the invention. Similarly, leg 38 shows such an opening 42 in the form of an elongate slot. Opening 42 could alternatively be in the form of a circular opening.

Figure 2:
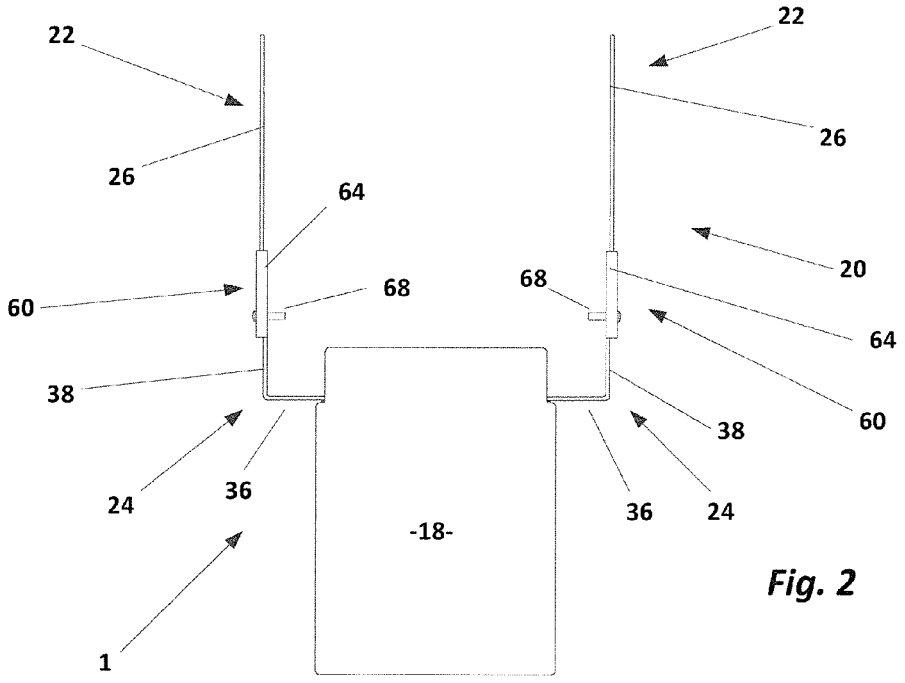
FIG. 2 is a top plan view of the shelf of FIG. 1.

As should be clear from FIGS. 1 and 2, one of the adjustment members 24 is coupled to the mounting plate 14 by placing face 44 of the adjustment member in face-to-face registration with surface 30 of mounting plate 14 such that the opening 40 in the adjustment member 24 is aligned with one of the slots 32 or 34 of the mounting plate 14. A suitable fastener, for example, a bolt, can be inserted through the opening 40 of the adjustment member and the aligned slot 32 or 34 of the mounting plate 24. A nut can then be placed on the bolt and tightened to secure the adjustment member 24 to the mounting plate 14. One skilled in the art will recognize that the structure of the mounting plate 14, the adjustment member 24, and the fastener permits the location of attachment and thus the distance between the two arms 22 of bracket 20 to be adjusted. Likewise, the angle of the adjustment member 24 relative to the mounting plate 14 can be adjusted since only one fastener is used to couple the adjustment plate 24 to the mounting plate 14. When it is desired to have rotation of the adjustment member 24 relative to the mounting plate 14 inhibited, the top plate 18 can extend rearwardly beyond the frame 10 such that the underside of the top plate 18 engages the top of the adjustment member 24 and acts as a stop preventing such rotation.

While the drawings show slots 32/34 in the mounting plate 14 and a round hole 40 in adjustment member 14 which cooperate with a fastener to attach the mounting plate 14 and the adjustment members 24, the reader should understand that, to increase the adjustability further, the round hole 40 in the adjustment member 24 can be replaced with a slot. To ease assembly, the hole 40 can be replaced with an integrally formed threaded member which projects through one of the slots 30/32 and to which a nut is attached. Alternatively, opening 40 can be in the form of a slot and the fastener can include an integrally threaded member projecting from the mounting plate through the slot. Likewise, the position of the round hole 40 and slots 32/34 can be reversed such that the opening 40 is an elongate slot and the slots 32/34 are each round holes. The slots can also be replaced by a series of round holes, but this eliminates infinite adjustment while still providing a finite set of attachment points between the two extreme positions of the adjustment members 24 relative to the mounting plate 14.

Figure 4:
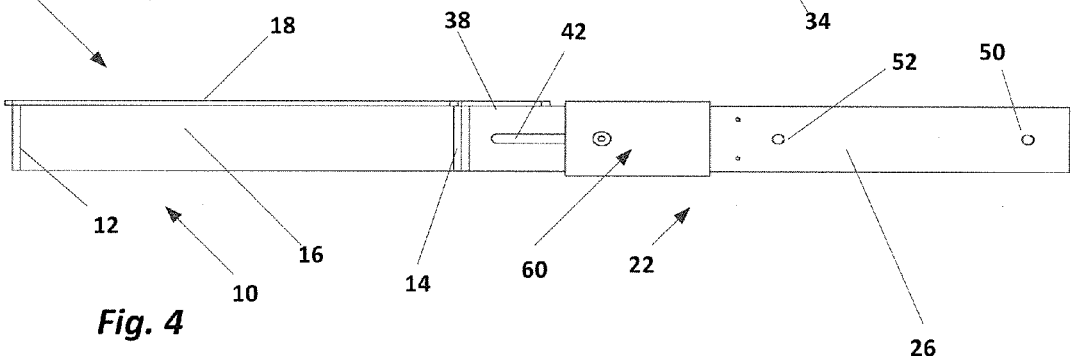
FIG. 4 is a side elevational view of the shelf shown in FIG. 1.

As shown in the drawings, the mounting members 26 of the two legs 22 of the bracket 20 each include three mounting holes 50, 52 and 54. A fastener such as bolt 68 can be passed through hole 54 of the mounting member and through the slot 42 of an adjustment member 24. A nut can then be secured to the bolt to couple the mounting member to the adjustment member. Given this arrangement, the overall length of the arm 22 of the bracket 20 can be adjusted by moving the bolt 68 back and forth within the slot 42 until the desired length is obtained. The nut can then be tightened to secure the mounting member and the adjustment member together at the appropriate location. Because only one bolt is used to fasten together the adjustment member 24 and the mounting member 26 of each arm 22, the angle of the mounting member 26 relative to the adjustment member 24 can be adjusted. When one wishes to preclude such rotation of the mounting member 26 relative to the adjustment member 24, a bracket 60 shown in FIGS. 1, 2 and 4 may be employed. The bracket 60 has a U-shaped cross-section including surfaces 62, 64 and 66. The bracket 60 also includes a hole through which the bolt 68 of the fastener also passes to secure the bracket 60, the mounting member 26 and the second leg 38 of the adjustment member 24 together. Because plates 64 and 66 of bracket 60 engage the edges of the mounting member 22 and the second leg 38 of the adjustment member 24, rotation of the mounting member 26 relative to the adjustment member 24 is precluded by the bracket 60.

Just as the adjustable means for connecting the adjustment members 24 to the mounting plate 14 can be modified, so can the adjustable means for connecting the mounting members 26 to the adjustment members 24. The round hole 54 could be replaced with a series of holes or with a slot. The slot 42 could then be replaced with a single hole. The bolt 68 could be replaced with a threaded member integrally formed with the clamp 60, the adjustment member 24 or the mounting member 26. What is important is that the presence of slots and holes in such members through which the bolt 68 or integrally formed threaded member passes permit the length of the arms 22 of the bracket 20 to be independently adjusted.

Based upon the foregoing description and what is shown in the drawings, one of ordinary skill in the art will appreciate that the distance between the two arms 22 of bracket 20 is adjustable by virtue of the way the slots 32 and 34 of the mounting plate 14 and the holes 40 of adjustment members 24 cooperate with the fasteners used to couple the adjustment members 24 to the mounting plate 14. One skilled in the art will also appreciate that the length of the arms 22 of bracket 20 are also adjustable by virtue of the way the slots 42 of the adjustment members 24 and the holes 54 of the mounting members 26 cooperate with the fasteners 68 used to attach the mounting members 26 to the adjustment members 24.

Figure 7:
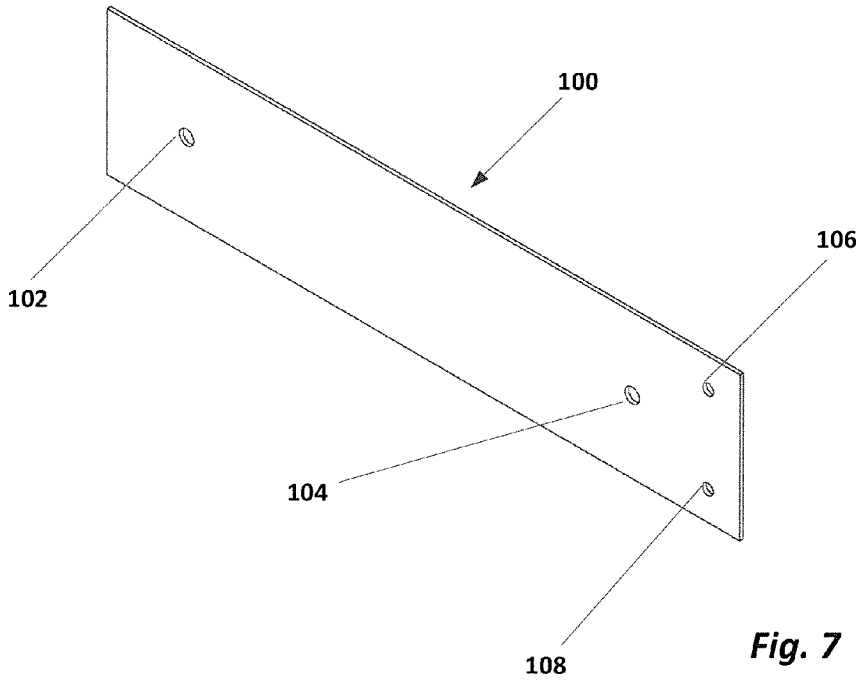
FIG. 7 is a perspective view of a template used to define the location of pilot holes to be drilled into a support when mounting the shelf of FIG. 1 to the support.
Figure 8:
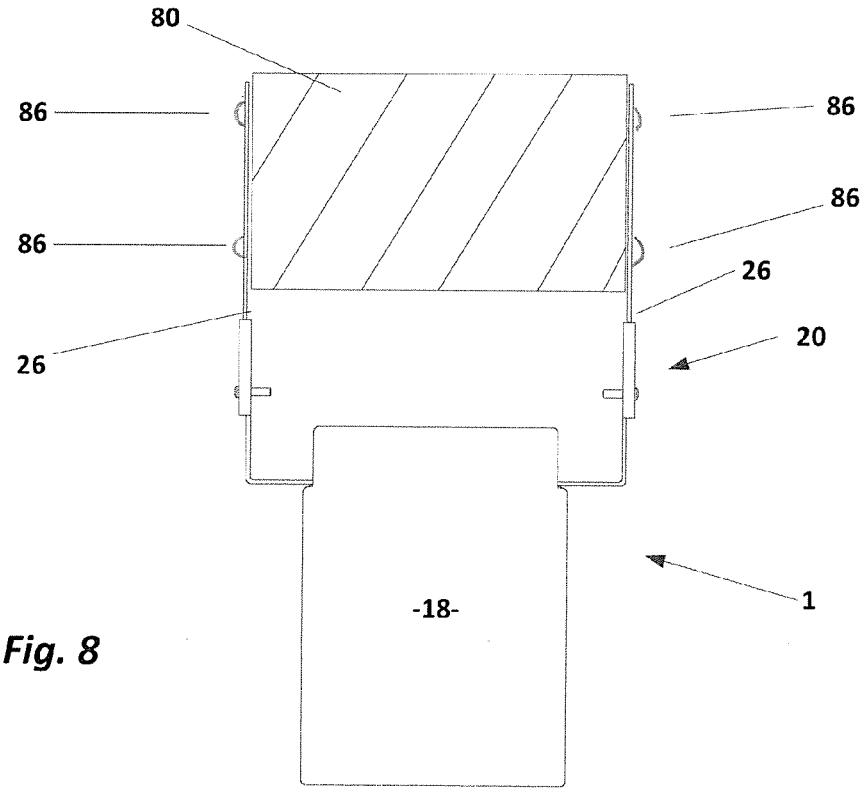
FIG. 8 is a top plan view of the shelf shown attached to a support structure having a single support.
Figure 9:
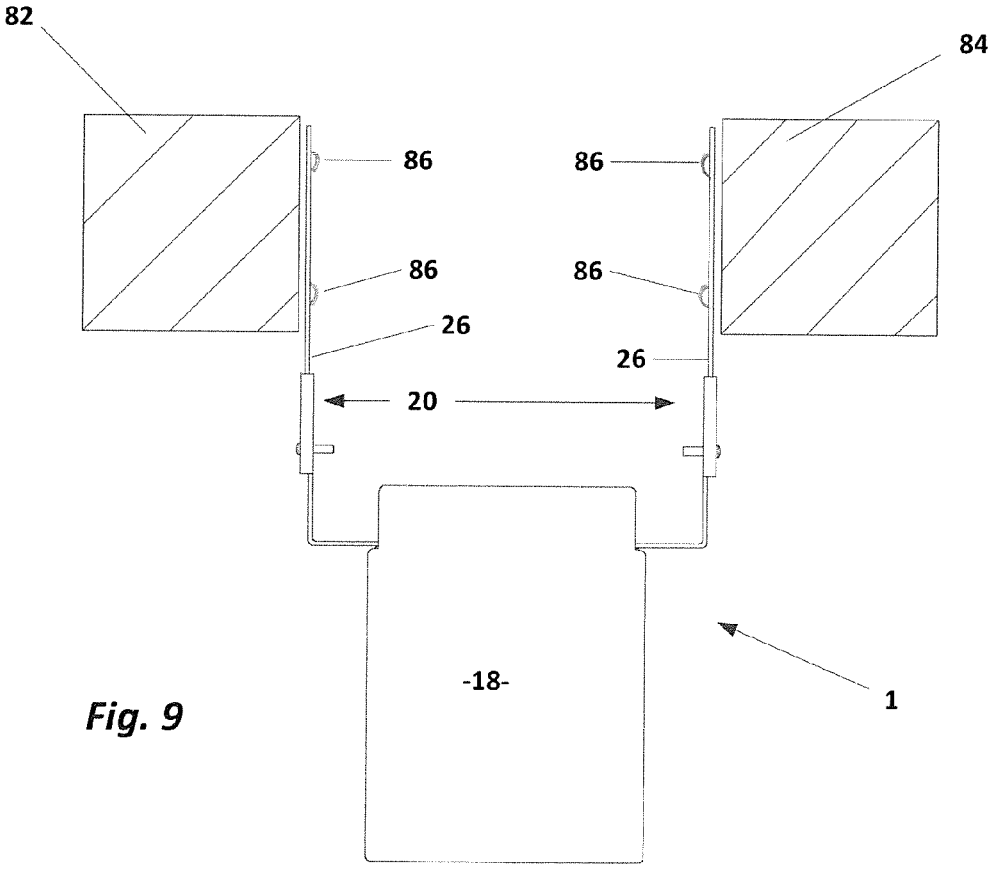
FIG. 9 is a top plan view of the shelf attached to a support structure having two spaced apart supports.

When the shelf 1 is employed, the mounting members 26 of the bracket 20 are used to fasten the bracket to one or more support members 80 (shown in FIG. 8). For example, a single support member may be positioned between the two mounting members 26 of the bracket 20. Alternatively, the two mounting members of bracket 20 may be positioned between two separate supports 82 and 84 as shown in FIG. 9 such that the supports 82 and 84 are positioned on the outside of the bracket 20. In either case, the arms can be attached to the support (or supports) using fasteners such as screws 86. When the fastener are screws such as 86, it is beneficial to drill holes in the support(s) 80 or 82 and 84 which are aligned with the holes 50 and 52 of the mounting members 26 of arms 22 of the bracket 20. To assist a user to properly place such holes, a template 100 as shown in FIG. 7 may be provided. The holes 102 and 104 in the template 100 are the same distance apart as the holes 50 and 52 of the arms 26. In the event the arms 26 are provided with additional holes such as 25 and 27, the template can also be provided with complementary holes 106 and 108.

As noted above, shelves of this type have particular utility when attached to a boat to hold an anchor and an anchor line. In such cases, the top plate 18 of shelf 1 extends from the front or back of the boat to limit clutter in the boat and to prevent water from the anchor and line from entering the boat. When the shelf 1 is used in this fashion, the arms 22 of the bracket 20 are attached to a supporting structure or structures of the boat itself. Shelves such as the one described may also be used in other environments. For example, the shelf of the present invention may be attached to the post of a deck to provide a support for plants, audio speakers, or the like.

While the present invention has been described with reference to boats and other marine crafts and is ideally suited for supporting anchors when not being used to anchor the boat, such shelving of the present invention may be used in a variety of other ways to support a variety of other objects. Thus, the foregoing description is not intended to be limiting. Instead, the scope of the invention is only limited by the following claims.

What is claimed is:

1. A shelf adapted to be attached to a support structure of a boat, the shelf comprising:

(a) a support structure of a boat;

(b) a frame having a front plate, a mounting plate having a mounting surface and spaced from the front plate and a pair of spaced apart side plates connecting the mounting plate and the front plate;

(c) a top plate supported above and by the frame and extending perpendicular to the mounting surface from the mounting plate toward the front plate;

(d) a bracket supporting the frame, the bracket comprising first and second arms extending substantially parallel to each other from the mounting plate away from the front plate, each arm comprising an adjustment member including a first leg, said first leg in face-to-face registration with the mounting surface of the mounting plate, and a second leg extending from the first leg in a direction substantially normal to the first leg;

(e) first fasteners cooperating with the first legs of the arms and the mounting plate to couple the first and second arms to the mounting plate so that the arms are positioned a desired distance from each other, said distance being adjustable; and (f) second fasteners coupling the arms to the support structure of the boat; wherein the support structure of the boat includes a pair of spaced apart members, the bracket is positioned between the pair of spaced apart members of the support structure of the boat and each arm of the bracket is attached to the member of the pair of members adjacent to the arm using the second fasteners.

* * * * *